US011117723B2

(12) United States Patent
Bagnall

(10) Patent No.: US 11,117,723 B2
(45) Date of Patent: Sep. 14, 2021

(54) BEVERAGE CAN COVER DEVICE AND METHOD

(71) Applicant: Alexander Morrison Bagnall, Duncan (CA)

(72) Inventor: Alexander Morrison Bagnall, Duncan (CA)

( * ) Notice: Subject to any disclaimer, the term of this patent is extended or adjusted under 35 U.S.C. 154(b) by 325 days.

(21) Appl. No.: 15/362,913

(22) Filed: Nov. 29, 2016

(65) Prior Publication Data

US 2018/0148238 A1 May 31, 2018

(51) Int. Cl.
*B65D 51/00* (2006.01)

(52) U.S. Cl.
CPC .... *B65D 51/007* (2013.01); *B65D 2517/0041* (2013.01); *B65D 2517/0098* (2013.01)

(58) Field of Classification Search
CPC ..... B65D 51/12; B65D 2517/0014; B65D 2517/0022
USPC ..... 220/229, 730, 729
See application file for complete search history.

(56) References Cited

U.S. PATENT DOCUMENTS

| | | | | |
|---|---|---|---|---|
| 4,869,389 | A | 9/1989 | Cerrone, Jr. | |
| 5,887,742 | A | 3/1999 | Lewis | |
| 6,053,347 | A | 4/2000 | Fullin | |
| 6,290,084 | B1 * | 9/2001 | Louie | B65D 43/0256 220/254.4 |
| 8,201,706 | B2 * | 6/2012 | Dembowiak | B65D 17/4012 220/730 |
| 2007/0075089 | A1 | 4/2007 | Stein | |

* cited by examiner

*Primary Examiner* — Anthony D Stashick
*Assistant Examiner* — James M Van Buskirk
(74) *Attorney, Agent, or Firm* — Runyan Law; Charles Runyan

(57) ABSTRACT

A cover for a beverage can includes a circular disc, an opening within the circular disc, and a raised lip fixedly attached to a circumference of the circular disc. The cover for a beverage can is useful for providing a means for covering a beverage can when in an opened condition, so as to prevent insects and debris from entering the beverage, to prevent release of carbonated gas from the beverage and to prevent premature warming of the beverage.

11 Claims, 5 Drawing Sheets

BEVERAGE CAN COVER DEVICE AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of beverage cans and more specifically relates to covers for beverage cans.

2. Description of Related Art

A beverage can is a metal container designed to hold a variety of liquid beverages such as carbonated soft drinks, alcoholic beverages, fruit juice, etc. The pull-tab type has long been the standard container-dispenser. Soft drinks, beer, fruit and vegetable juices are commonly packaged in such containers. Typically, pull-tab openers are secured to the top surface of the beverage can at a location adjacent a push-in closure. As the pull-tab is lifted by a user, the opener engages the push-in closure causing the closure to rupture at its outer periphery to allow the user access to the beverage. However, pull-tab type beverage containers suffer from great disadvantages.

Firstly, when the beverage can is in an opened condition, foreign particles such as dirt, dust or the like may inadvertently enter the beverage can. Outdoor gatherings at which beverages are served are a universally enjoyed pastime, but the risk of debris entering the beverage can is furthered when the beverage is outdoors. Additionally, insects, such as bees or wasps, may be attracted to the sugars, fruit or malt flavoring found in such beverages. This is unhygienic and in the case of a bee or bees collecting around the opening in the can, these insects may bite or sting an unsuspecting individual attempting to take a sip from the beverage can.

A second problem with pull-tab type beverage containers is that once open, the carbon dioxide begins to escape through the opening. This is concerning as a consumer will usually takes a few swallows and then lay down their beverage down for periodic consumption. The more the beverage is exposed to air the more carbonation is lost, so the beverage usually loses its freshness before the user has consumed the whole beverage. This carbonation loss is furthered outdoors. In addition, exposure to the outdoor air can cause the liquid to prematurely warm. Thus, a need exists for a protective cover for a beverage can.

U.S. Pat. No. 8,201,706 to Dembowiak et al. relates to a can cover and method. The described can cover and method includes a generally flat sheet and a disc removably connected to the sheet. The disc includes a first side, a second side, an opening therethrough. Indicia is provided on the first side of the disc. The disc is receivable on the pop-top can such that the second side engages the rim of the pop-top can and the pop-top extends through the opening in the disc.

BRIEF SUMMARY OF THE INVENTION

In view of the foregoing disadvantages inherent in the known covers for beverage cans art, the present disclosure provides a novel beverage can cover device. The general purpose of the present disclosure, which will be described subsequently in greater detail, is to provide a beverage can cover device.

A cover for a beverage can is disclosed herein. The cover for a beverage can includes a circular disc having a substantially flat body, an opening within the circular disc configured to receive the pull-tab of the beverage can when in an opened condition so as to retain the cover on the top of the beverage can, and a raised lip fixedly attached to a circumference of the circular disc. The cover may be configured to provide a means for covering said beverage can when in said opened condition.

According to another embodiment, a cover for a beverage can is also disclosed herein. The cover for a beverage can includes a plastic circular disc having a substantially flat body, an opening within the circular disc configured to receive the pull-tab of the beverage can when in an opened condition so as to retain the cover on a top of the beverage can, and a plastic raised lip fixedly attached to a circumference of the circular disc. According to this embodiment, the circular disc may have a diameter of at least 3 inches. According to this embodiment, the opening may be configured for receiving a variety of differently sized pull-tabs. In one embodiment the pull-tab may have a thickness of at least 0.0600 inches. Further, the opening may run through a complete diameter at a midpoint of the circular disc.

According to another embodiment, a method of using a cover for a beverage can is also disclosed herein. The method of using a cover for a beverage can includes squeezing opposing sides of the raised lip of the cover to widen an opening within the cover, sliding the cover over the beverage can in the opened condition, and inserting the pull-tab of the beverage can into the opening within the cover. Further steps may include, removing the pull-tab from within the opening of the cover to slide the cover from the beverage can when a liquid retained within the beverage can is to be consumed, and sliding the cover onto the beverage can again to protect the liquid retained within the beverage can.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a beverage can cover device and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to covers for beverage cans and more particularly to a beverage can cover device and method as used to improve the means for covering a beverage can when in an opened condition.

Generally, the beverage can cover device is a plastic sliding cover with a fine cut slot in the centre of the cover to encompass the ring pull and can top. It is specifically for any can of average circumference containing any liquid that has a ring pull and it is for use with such can once it is opened. There may be a flexibility to the middle of the cover to allow the centre to raise slightly when both side are pressed, allowing the cover to be able to slide onto the can top easily and quickly. The cover may also have a small raised side all the way around its circumference.

The beverage can cover may prevent insects or debris from entering or falling into the can once it is opened and placed down for any period of time or left unattended. It may also slow down the release of carbonated gas from the can and may further slow down the warming of liquids inside the can.

Figure 1:
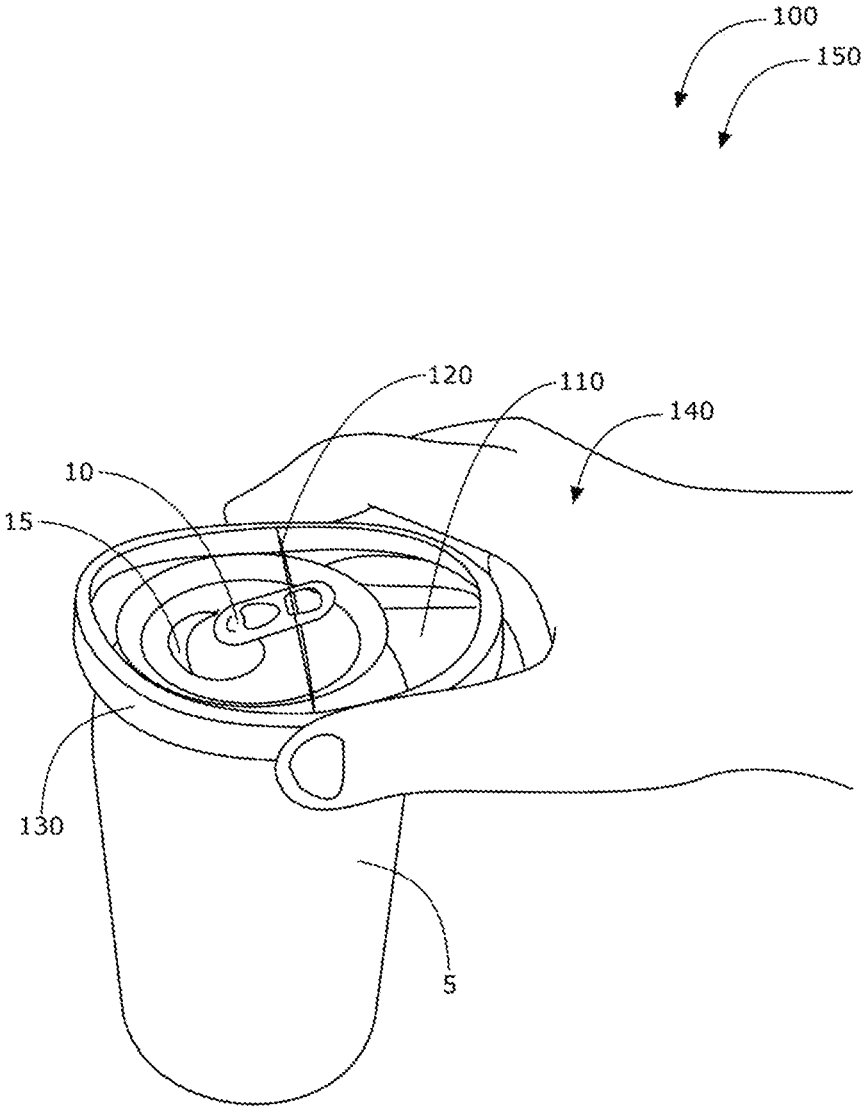
FIG. 1 is a perspective view of the cover during an 'in-use' condition, according to an embodiment of the disclosure.

Referring now more specifically to the drawings by numerals of reference, there is shown in FIGS. 1-4, various views of a cover 100 for a beverage can 5. FIG. 1 shows a cover for a beverage can ("cover" 100) during an 'in-use' condition 150, according to an embodiment of the present disclosure. Here, the cover 100 may be beneficial for use by a user 140 to provide a means for covering a beverage can 5 when in an opened condition. As illustrated, the cover 100 may include a circular disc 110, an opening 120 within the circular disc 110 and a raised lip 130 fixedly attached to a circumference of the circular disc 110.

According to one embodiment, the cover 100 may be arranged as a kit 105. In particular, the cover 100 may further include a set of instructions 155. The instructions 155 may detail functional relationships in relation to the structure of the cover 100 (such that the cover 100 can be used, maintained, or the like, in a preferred manner).

Figure 2:
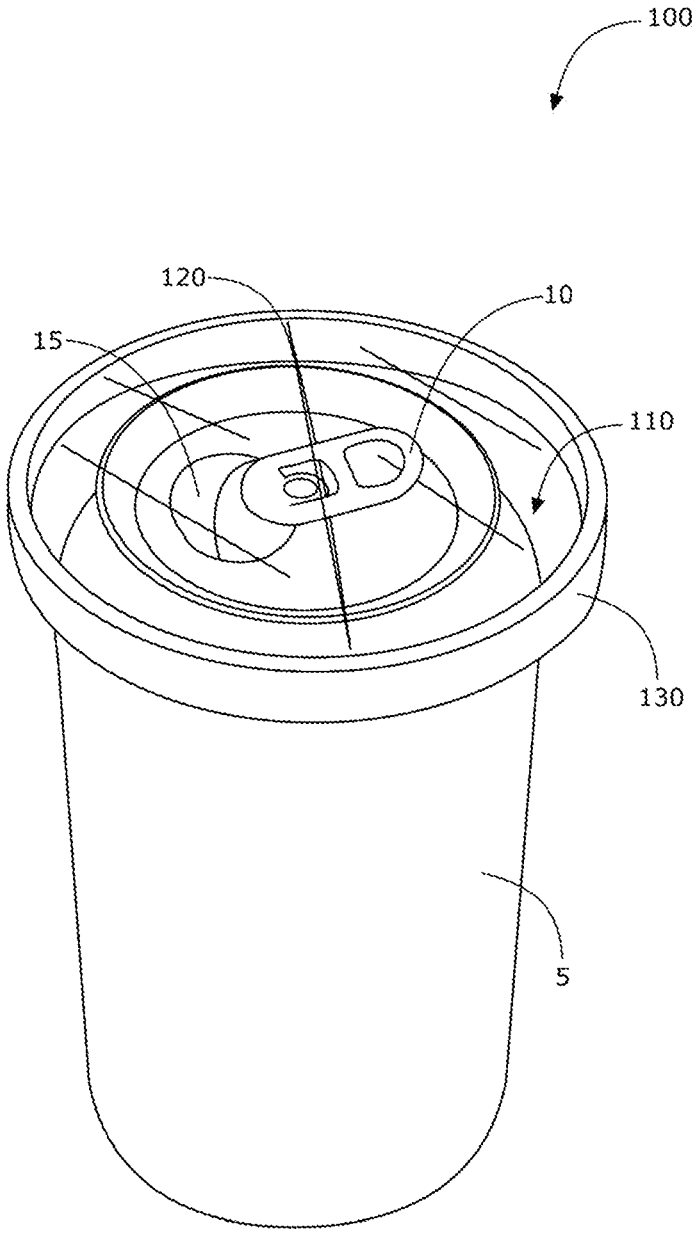
FIG. 2 is a perspective view of the cover of FIG. 1 attached to a top of a beverage can, according to an embodiment of the present disclosure.

FIG. 2 shows the cover 100 of FIG. 1, illustrating a view of the cover 100 attached to the beverage can 5 and demonstrating how the cover 100 attaches to the beverage can 5 through the insertion of the pull-tab 10 of the beverage can 5 into the opening 120 of the circular disc 110. As above, the cover 100 may include the circular disc 110 having a substantially flat body, the opening 120 within the circular disc 110 which may be configured to receive the pull-tab 10 of the beverage can 5 when in an opened condition 15 so as to retain the cover 100 on the top of the beverage can 5 and the raised lip 130 fixedly attached to the circumference of the circular disc 110.

In the preferred embodiment, the cover 100 may be configured to provide a means for covering the beverage can 5 when in the opened condition 15. The cover 100 may further be configured for use on a variety of differently sized beverage cans 5. For example, in the preferred embodiment, the circular disc 110 may have a diameter of at least 3 inches. In a further embodiment, the circular disc 110 may have the diameter of between 3 inches and 5 inches. In the preferred embodiment, the circular disc 110 may be composed of a plastic material.

The cover 100 may be further configured to prevent insects and debris from entering the beverage can 5 when in the opened condition 15. Similarly, the cover 100 may be configured to prevent release of carbonated gas from a liquid retained within the beverage can 5 and to prevent the liquid from premature warming when in the opened condition 15.

The opening 120 is shown to receive the pull-tab 10 of the beverage can 5 in the opened condition 15 when the cover 100 is slid onto the top of the beverage can 5. The opening 120 may run through a complete diameter at a midpoint of the circular disc 110. Further, the opening 120 may be configured for receiving a variety of differently sized pull-tabs 10. For example, in one embodiment, the opening 120 may be configured to receive a pull-tab 10 having a thickness of at least 0.0600 inches.

In addition, the opening 120 may have a brevity configured to retain the pull-tab 10 with sufficient grip so as to effectively prevent movement of the cover 100 from the beverage can 5. Furthermore, the opening 120 may have a flexibility configured to contourly-receive the pull-tab 10 of the beverage can 5.

Figure 3:
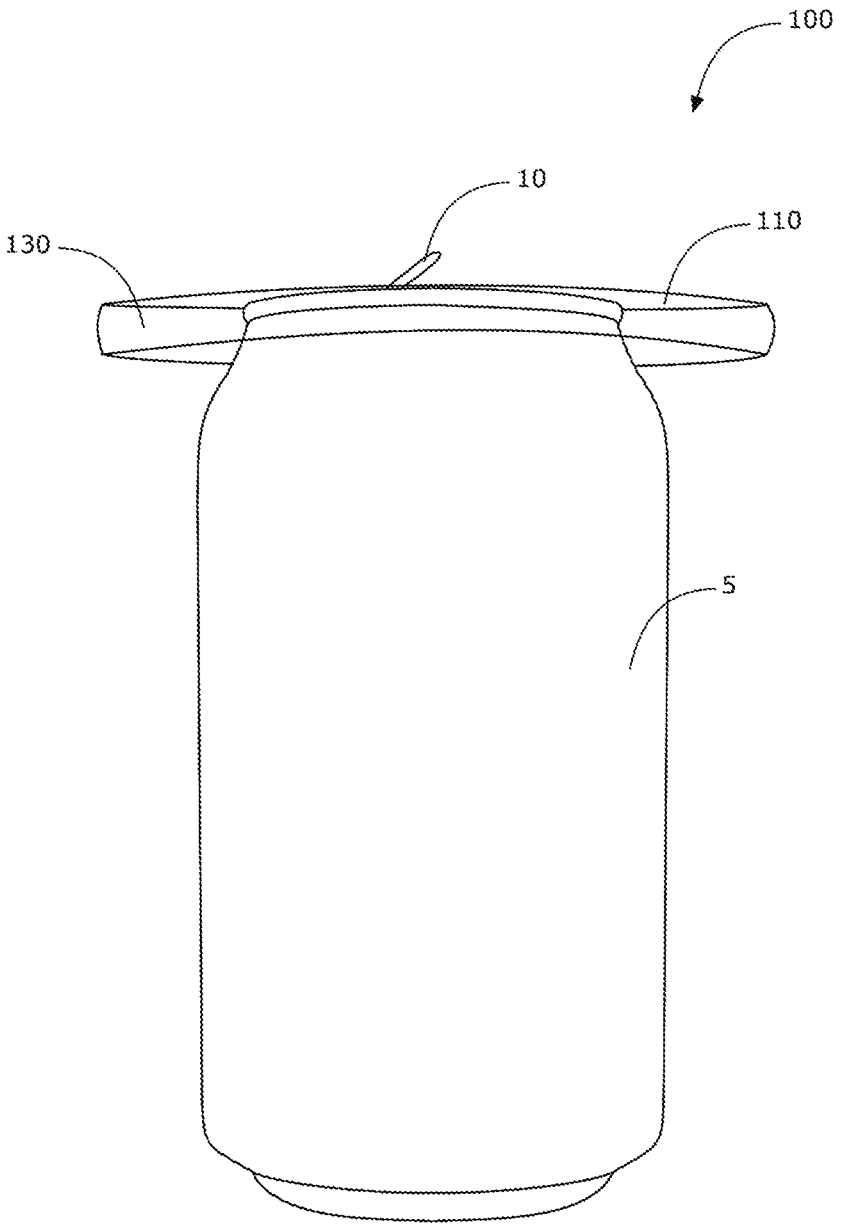
FIG. 3 is a side view of the cover of FIG. 2 attached to a top of a beverage can, according to an embodiment of the present disclosure.

FIG. 3 is a side view of the cover 100 of FIG. 1, according to an embodiment of the present disclosure. Here the cover 100 is shown attached to the beverage can 5. The cover 100 may include the circular disc 110 having the substantially flat body, the opening 120 within the circular disc 110 which may be configured to receive the pull-tab 10 of the beverage can 5 when in the opened condition 15 so as to retain the cover 100 on the top of the beverage can 5 and the raised lip 130 fixedly attached to the circumference of the circular disc 110.

Demonstrated is the cover 100 having a diameter greater than that of the beverage can 5. As above, the cover 100 may be configured for use on a variety of differently sized beverage cans 5. For example, in the preferred embodiment, the circular disc 110 may have a diameter of at least 3 inches. In a further embodiment, the circular disc 110 may have the diameter of between 3 inches and 5 inches. In the preferred embodiment, the circular disc 110 may be composed of a plastic material. Other materials may be used.

The raised lip shown may be configured for positive grip of the circular disc 110 when sliding the cover 100 on and off the beverage can 5. Relatedly, the opening 120 may be manipulated by squeezing opposing sides of the raised lip 130 to aid in receival and removal of the pull-tab 10 of the beverage can 5. In the preferred embodiment, the raised lip 130 may be composed of a plastic material. Other materials may be used.

Figure 4:
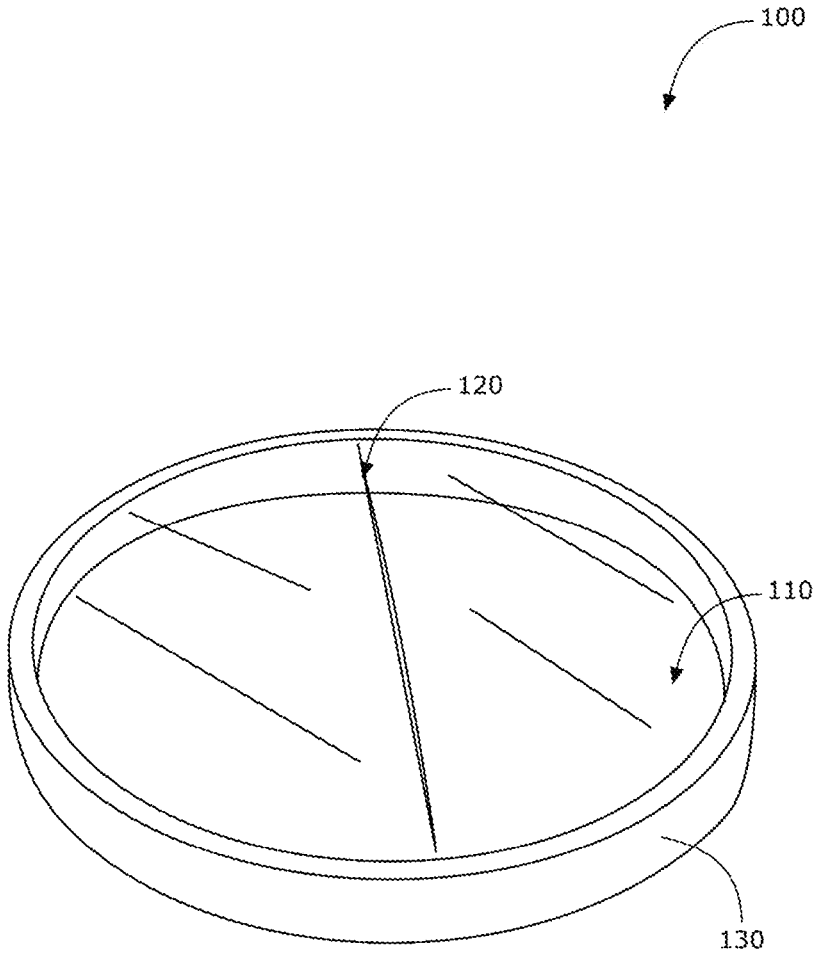
FIG. 4 is a perspective view of the cover of FIG. 1, according to an embodiment of the present disclosure.

FIG. 4 is a perspective view of the cover 100 of FIG. 1, according to an embodiment of the present disclosure. Illustrated here is the cover 100 in isolation including a circular disc 110 having a substantially flat body, an opening 120 within the circular disc 110 may be configured to receive the pull-tab 10 of the beverage can 5 when in an opened condition 15 so as to retain the cover 100 on the top of the beverage can 5 and a raised lip 130 fixedly attached to a circumference of the circular disc 110. The cover 100 may be configured to prevent insects and debris from entering the beverage can 5 when in the opened condition 15. Similarly, the cover 100 may be configured to prevent release of carbonated gas from a liquid retained within the beverage can 5 and to prevent the liquid from premature warming when in the opened condition 15.

The opening 120 shown may be configured to receive the pull-tab 10 of the beverage can 5 in the opened condition 15 when the cover 100 is slid onto the top of the beverage can 5. The opening 120 may run through a complete diameter at a midpoint of the circular disc 110. Further, the opening 120 may be configured for receiving a variety of differently sized pull-tabs 10. For example, in one embodiment, the opening 120 may be configured to receive a pull-tab 10 having a thickness of at least 0.0600 inches. Other dimensions may be used.

In addition, the opening 120 may have a brevity configured to retain the pull-tab 10 with sufficient grip so as to effectively prevent movement of the cover 100 from the beverage can 5. Furthermore, the opening 120 may have a flexibility configured to contourly-receive the pull-tab 10 of the beverage can 5.

Further, the raised lip 130 shown may be configured for positive grip of the circular disc 110 when sliding the cover 100 on and off the beverage can 5. Relatedly, the opening 120 may be manipulated by squeezing opposing sides of the raised lip 130 to aid in receival and removal of the pull-tab 10 of the beverage can 5. In the preferred embodiment, the raised lip 130 may be composed of a plastic material.

Figure 5:
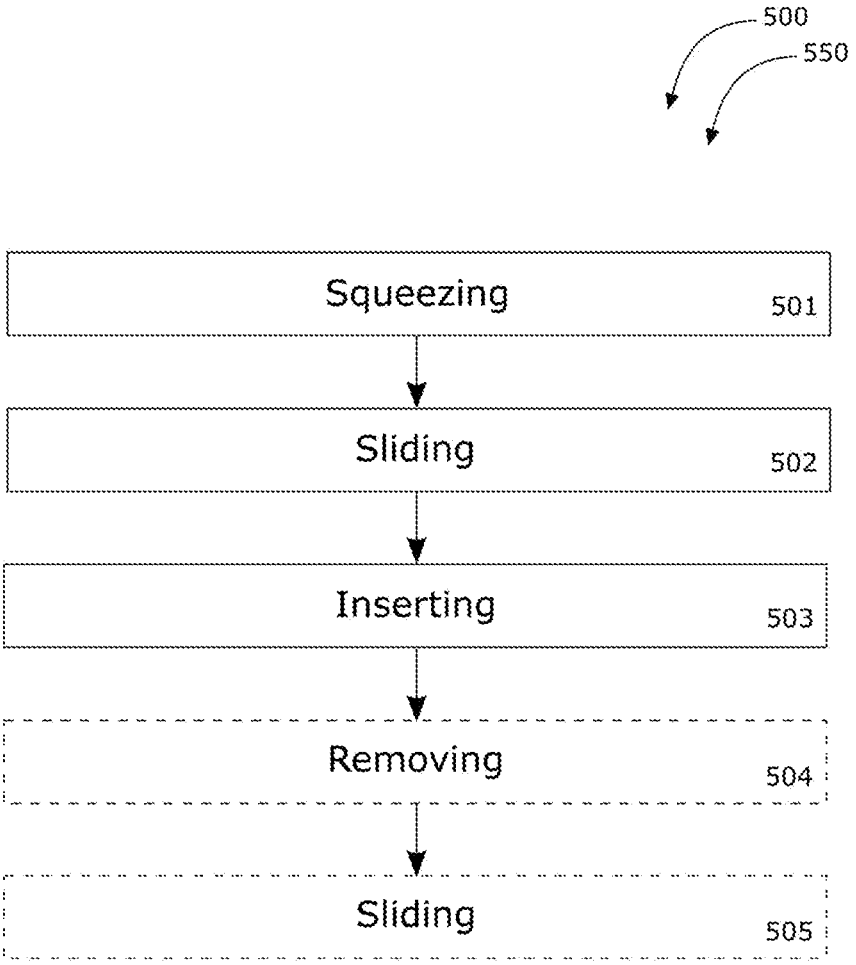
FIG. 5 is a flow diagram illustrating a method of using a cover for a beverage can, according to an embodiment of the present disclosure.

FIG. 5 is a flow diagram illustrating a method 500 for using a cover 100 for a beverage can 5, according to an embodiment of the present disclosure. In particular, the method 500 for using a cover 100 for a beverage can 5 may include one or more components or features of the cover 100 as described above. As illustrated, the method 500 for using a cover 100 for a beverage can 5 may include the steps of: step one 501, squeezing opposing sides of the raised lip of the cover to widen an opening within the cover; step two 502, sliding the cover over the beverage can in the opened condition; and step three 503, inserting a pull-tab of the beverage can into the opening within the cover. Further steps may include; step four 504, removing the pull-tab from within the opening of the cover to slide the cover from the beverage can when a liquid retained within the beverage can is to be consumed; and step five 505, sliding the cover onto the beverage can again to protect the liquid retained within the beverage can.

It should be noted that steps four 504 and five 505 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a cover for a beverage can (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A cover for a beverage can, said beverage can including a top having a pull-tab, said cover comprising:

a circular disc having a substantially flat body;

an opening within said circular disc configured to receive said pull-tab of said beverage can when in an opened condition so as to retain said cover on said top of said beverage can;

a raised lip fixedly attached to a circumference of said circular disc;

wherein said cover is configured to provide a means for covering said beverage can when in said opened condition;

wherein said opening is configured for receiving a variety of differently sized pull-tabs, pull-tab having a thickness of at least 0.0600 inches;

wherein said opening is configured to receive said pull-tab of said beverage can in said opened condition when said cover is slid onto said top of said beverage can, and said opening having a flexibility configured to receive said pull-tab of said beverage can;

wherein said opening further has a brevity configured to retain said pull-tab with sufficient grip so as to effectively prevent movement of said cover from said beverage can;

and wherein said raised lip is configured for positive grip of said circular disc when sliding said cover on and off said beverage can, and said opening is manipulated by squeezing opposing sides of said raised lip to aid in receival and removal of said pull-tab of said beverage can.

2. The cover of claim 1, further configured for use on a variety of differently sized beverage cans.

3. The cover of claim 1, wherein said circular disc has a diameter of at least 3 inches.

4. The cover of claim 3, wherein said circular disc has said diameter of between 3 inches and 5 inches.

5. The cover of claim 4, wherein said opening runs through a complete said diameter at a midpoint of said circular disc.

6. The cover of claim 1, wherein said circular disc is composed of a plastic material.

7. The cover of claim 6, wherein said raised lip is composed of a plastic material.

8. The cover of claim 1, wherein said cover is further configured to prevent insects and debris from entering said beverage can when in said opened condition.

9. The cover of claim 8, wherein said cover is configured to prevent release of carbonated gas from a liquid retained within said beverage can and to prevent said liquid from premature warming when in said opened condition.

10. A method of using a cover for a beverage can, the method comprising the steps of:

squeezing opposing sides of a raised lip of said cover to widen an opening within said cover;

sliding said cover over said beverage can in an opened condition; and inserting a pull-tab of said beverage can into said opening within said cover.

11. The method of claim 10, further comprising the steps of removing said pull-tab from within said opening of said cover to slide said cover from said beverage can when a liquid retained within said beverage can is to be consumed; and sliding said cover onto said beverage can again to protect said liquid retained within said beverage can.

* * * * *